United States Patent [19]

Bowman

[11] 4,210,617

[45] Jul. 1, 1980

[54] METHOD OF CASTING AN INTEGRAL SLIDE GATE AND NOZZLE

[75] Inventor: Jan Bowman, Orinda, Calif.

[73] Assignee: Kaiser Aluminum & Chemical Corporation, Oakland, Calif.

[21] Appl. No.: 930,785

[22] Filed: Aug. 3, 1978

[51] Int. Cl.[2] ..... B28B 1/04; B28B 1/10

[52] U.S. Cl. ..... 264/71; 222/559; 222/561; 264/60

[58] Field of Search ..... 264/60, 71, 72; 222/561, 559

[56] References Cited

U.S. PATENT DOCUMENTS

| | | | |
|---|---|---|---|
| Re. 27,237 | 11/1971 | Shapland | 222/561 |
| 2,008,117 | 7/1935 | Tone | 264/71 |
| 2,843,646 | 7/1958 | Conant | 264/60 |
| 3,492,383 | 1/1970 | Heimgartner | 222/561 |
| 3,685,707 | 8/1972 | Shapland | 222/559 |
| 3,731,912 | 5/1973 | Kutzer | 222/561 |
| 3,841,539 | 10/1974 | Shapland et al. | 222/561 |

*Primary Examiner*—Donald J. Arnold

*Attorney, Agent, or Firm*—Paul E. Calrow; Malcolm McQuarrie

[57] ABSTRACT

Method of casting an integral slide gate and nozzle assembly wherein a casing (11) conforming to the exterior sides and bottom of the valve is placed upside down on a flat smooth plate (12), a tube (14) is placed within the mold so formed to produce a channel in the cast valve, a first castable refractory exhibiting good resistance to molten metal is cast in the bottom of the mold, a tube (19) is placed about the passage-forming tube (14), the same first refractory castable is cast between the two tubes, and a refractory of lesser resistance to molten metal is cast within the remainder of the mold, the second tube (19) being removed after the casting is complete. Preferably casting is carried out while vibration is applied to the mold, the vibration continuing until after removal of the second tube (19). The second refractory can be an insulating material. Preferably the first castable is a high alumina material, for example one containing over 70%, most preferably over 90%, $Al_2O_3$.

7 Claims, 3 Drawing Figures

METHOD OF CASTING AN INTEGRAL SLIDE GATE AND NOZZLE

BACKGROUND

The present invention pertains to slide gate valves, and particularly to a method of casting an integral slide gate and nozzle assembly for such a valve. More specifically, it comprises a method wherein a casing conforming to the exterior sides and bottom of the assembly is placed upside down on a flat smooth plate to form a mold, a tube conforming to the channel to be formed in the assembly is placed within the casing and refractory castable material is placed within the mold.

Slide gate valves are devices whereby the flow of molten metal such as steel from a ladle or tundish or other container is controlled by sliding or rotating a plate having an orifice into and out of alignment with a similar opening in the molten metal containing vessel. Such devices are shown, for example, in U.S. Pat. No. Re. 27,237. It is common to place a collector nozzle below the sliding plate and in alignment with the opening in the plate to guide the stream of molten metal in a single unit, for example as shown in U.S. Pat. Nos. 3,731,912 and 3,841,539.

Commonly, these units are made by forming, for example by pressing and firing, separate slide gate plates and collector nozzles, and assembling a slide plate and a nozzle in a metal casing, for example by embedding them in mortar in the casing. However, in order to obtain adequate flatness in such units, it has been necessary to grind their top surfaces after assembly. On the other hand, it is known to form an integral assembly comprising both the sliding plate and the dependent nozzle by casting refractory concrete into a metal casing, such unit not requiring grinding if the top surface of the valve is cast against a smooth surface.

One problem with such casting method of forming these assemblies is that the refractory castable used must be of sufficiently high quality that it will resist the action of molten steel. However, only the top surface and interior of the channel through the plate and nozzle are in contact with molten steel. Accordingly, the refractory castable used in the remainder of the structure is of higher quality, and consequently more expensive, than is needed.

The present invention offers a method of casting such assemblies which have a high grade refractory castable on the upper surface of the plate and along the metal flow channel through the plate and nozzle and a lower grade refractory in other portions of the assembly.

SUMMARY OF THE INVENTION

It has been found, according to this invention, that an integral slide gate and nozzle assembly composed of two different grades of refractory castable can be made by modifying the prior art method of casting such assemblies so that a measured amount of a first refractory castable of superior resistance to molten metal, sufficient in amount to form a layer (18) at least 1 cm thick on the bottom of the mold, is placed in the mold.

DETAILED DESCRIPTION

Figure 1:
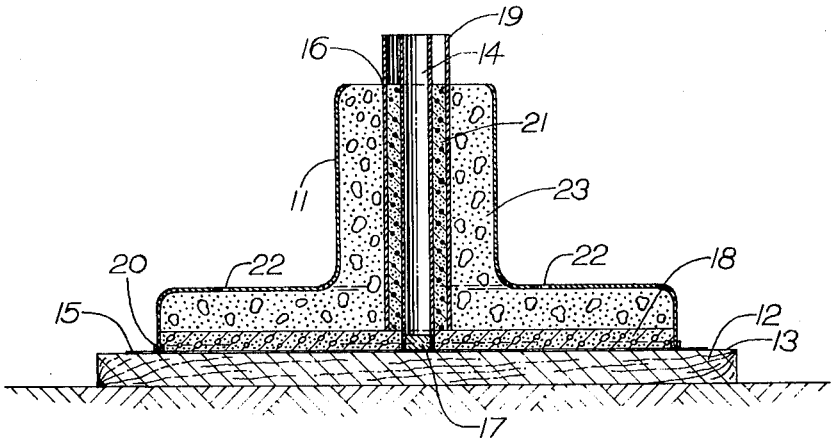
FIG. 1 is a vertical sectional view through a slide gate and nozzle assembly and accompanying mold made according to the present invention.
Figure 2A:
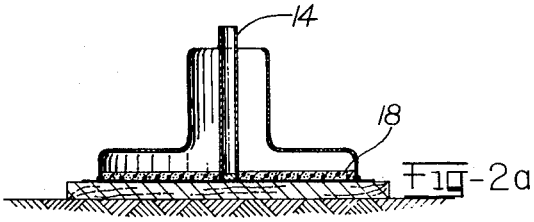
FIG. 2 is a series of schematic vertical sections similar to FIG. 1, but showing the various steps in the process of the present invention.
Figure 2D:
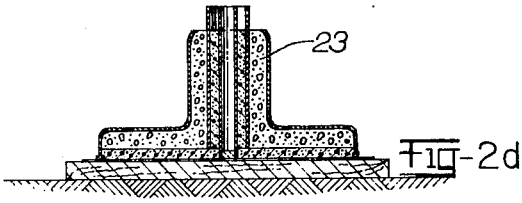
Figure 2B:
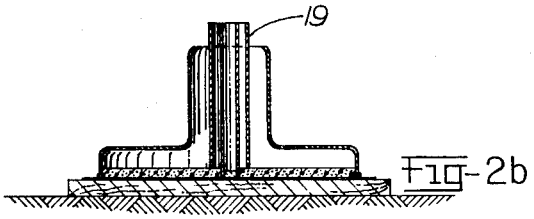
Figure 2E:
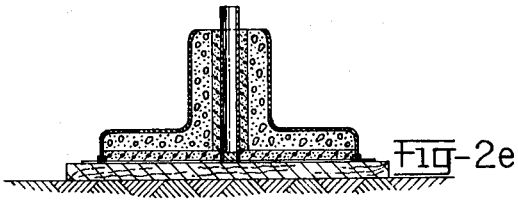
Figure 2C:
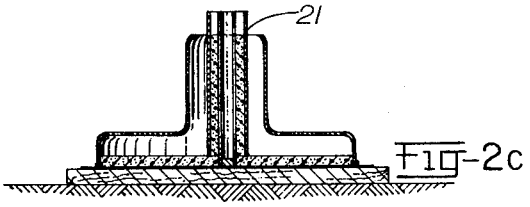
Figure 2F:
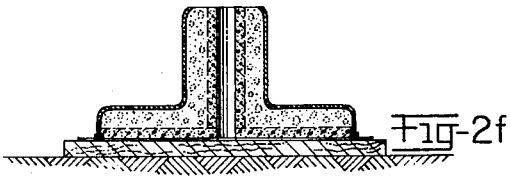

Although the present invention can be used to make assemblies for valves which operate by rotation, and to make assemblies in which the dependent nozzle is placed asymmetrically with respect to the sliding plate, the invention will be illustrated by describing its application to making an elongated assembly with a symmetrically disposed nozzle, the unit being intended to slide back and forth in operation.

A metal casing 11 for the assembly is placed upside down with its open top on a flat plate 12. Preferably plate 12 has on its upper face 13 an extremely smooth, even mirrorlike, finish 15, for example as provided by a layer of plastic or polished metal. Preferably a gasket 20 is placed between casing 11 and finish 15. An inner or first tube 14, of diameter equal to the desired bore of the channel to be formed in the assembly, is placed through opening 16 in the bottom of the metal casing and held in position on plate 12, for example by block 17. It will be evident that the length of tube 14 will be sufficient to project out of opening 16 in casing 11 and that tube 14 is fixing within opening 16. Although the piece 14 has been referred to as a "tube", it will be evident that it can be a solid rod, which can be anchored to plate 12, for example by a screw or bolt (not shown). The procedure to this point follows that known in the prior art.

Next, a measured amount of a first, higher grade refractory castable is placed within the mold, the amount of this material being sufficient to form a layer 18 at least 1 cm thick. Vibration may be applied to consolidate this material, as is well known in the art. FIG. 2 (*a*) illustrates this stage.

Next a second tube 19, of diameter at least 2 cm greater than the diameter of tube 14, is placed concentrically around tube 14. When tube 19 is in place, its lower end extends at least to the top surface of layer 18, and preferably penetrates slightly into that layer. Clearly, the upper end of tube 19 extends out of opening 16 in casing 11. FIG. 2 (*b*) illustrates this stage.

A further measured amount of the first refractory castable is placed within the space between tubes 14 and 19. Again vibration may be used to compact this material. The amount of material used in this step will be such that the collar 21 of first refractory material does not extend above the uppermost point of casing 11. FIG. 2 (*c*) illustrates this point in the process.

Next, a second, lower quality refractory castable 23 is placed within mold 11 but outside of tube 19. Again, vibration may be used to compact the material. FIG. 2 (*d*) shows this point in the process.

Finally, tube 19 is removed from the mold, as illustrated in FIG. 2 (*e*). Where vibration is used, it will preferably be continued until after tube 19 is removed, thus causing the two grades of refractory material to knit together along their line of contact, as shown in FIG. 2 (*f*).

Preferably metal casing 11 contains vent holes 22 to permit the escape of any air entrapped within the mold, as is well known in the casting art.

As an alternative, instead of casting all of the refractory in collar 21 at one time, followed by casting of all the second refractory material 23, it is possible to cast a portion of collar 19, for example 5 cm, then cast sufficient of the second refractory castable 23 to fill the mold to the same level as collar 21 and then, before casting further material, raise tube 19 to at or slightly below the level of refractory material already cast. This method of alternatively casting material within collar 19 and in the remainder of the mold, with gradual elevation of tube 19, can be continued until the mold is filled. Obviously, vibration can be carried out during this alternating casting process. Alternatively, the vibration may be done intermittently as part of the alternating casting steps.

Figure 3:
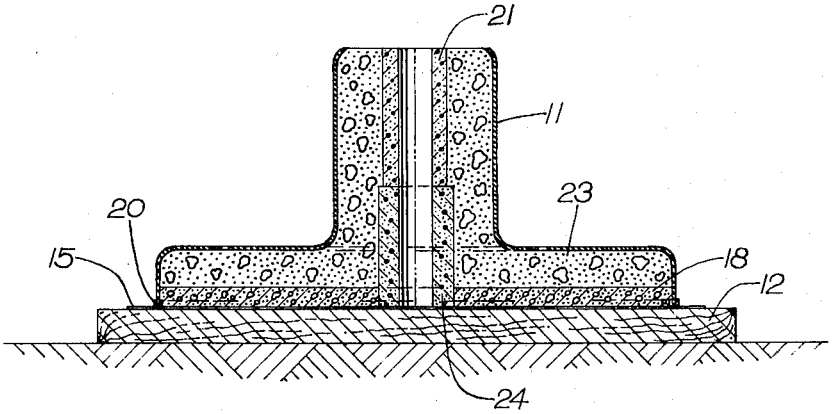
FIG. 3 is a vertical sectional view through an alternative form of an assembly made according to this invention.

In an alternative arrangement, illustrated in FIG. 3, a preformed, preferably fired, insert collar 24 can be placed about the bottom of tube 14 prior to placement of the bottom layer of first refractory 18. Tube 19 is then put in place, either surrounding insert 24 or abutting the top end of that insert, and the remainder of the process is carried on as previously described. In this way, the most critical wear area at the junction between the sliding surface and the channel through the assembly, can be made of an even more resistant refractory material.

The two grades of refractory castable used can be any such materials well known in the art. The first material will be a material which is particularly adapted to resist the attack of flowing molten metal, whereas the second material can be a less refractory, and presumably less expensive, material. In one embodiment of the invention, the second refractory castable can be a lightweight insulating castable. While many suitable materials will be evident to those skilled in the art, a first refractory castable which has been found to be quite suitable is a high alumina castable made up of about 75 parts by weight sized tabular alumina grain together with a binder of about 25 parts by weight calcium aluminate cement. In general, when the castable materials are aluminous or aluminosilicate materials, the first refractory (that is to say, the refractory forming the surface of the plate and the lining of the metal flow channel) will desirably contain at least 70% $Al_2O_3$, and most preferably about 90% or more $Al_2O_3$. The second castable can be any material, for example one containing less than 70% $Al_2O_3$, which is compatible chemically and physically with the first. By chemical compatibility is meant that the two materials will not form any low melting eutectic at the temperature of use and by physical compatibility is meant that the thermal expansion, shrinkage on drying, etc. will be sufficiently similar that cracks are not formed in the valve either upon drying or in use.

I claim:

1. Method of casting an integral slide gate and nozzle assembly, said assembly having a channel therethrough for passage of molten metal, wherein (A) a casing conforming to the exterior sides and bottom of the assembly and having an opening in the bottom in the region of the channel exit, is placed upside down on a flat smooth plate to form a mold, (B) a first tube conforming to the channel to be formed in the assembly is placed within casing with one end fixed to plate and the other end extending through and fixed within the opening in the bottom of the casing, and (C) refractory castable material is placed within the mold, characterized in that (D) a measured amount of a first refractory castable of superior resistance to molten metal, sufficient in amount to form a layer at least 1 cm thick on the bottom of the mold, is placed in the mold, (E) a second tube, of diameter at least 2 cm greater than that of the first tube, is placed concentrically about the first tube, its lower end extending to the refractory cast in step (D), (F) a further amount of the first refractory castable is placed between the first and second tubes to form a collar of that refractory, (G) a second refractory castable, of lesser resistance to molten metal than the first refractory castable, is placed in the mold outside of the second tube, and (H) the second tube is removed from the mold.

2. Method according to claim 1 wherein vibration is applied to the mold during the casting process.

3. Method according to claim 2 wherein at least some vibration is applied after removal of the second tube.

4. Method according to claims 1, 2, or 3 wherein the placements of steps (F) and (G) are carried out alternatively until the mold is filled.

5. Method according to claim 4 wherein, as the two placements (F) and (G) are carried out alternatively, the second tube is successively raised to near but not above the level of the lower of the two placements.

6. Method according to claims 1, 2 or 3 wherein the first refractory castable contains at least 70% $Al_2O_3$.

7. Method according to claims 1, 2, or 3 wherein the second refractory castable is of lower thermal conductivity than the first refractory castable.

* * * * *